US009607782B2

(12) United States Patent
Fröhlich et al.

(10) Patent No.: US 9,607,782 B2
(45) Date of Patent: Mar. 28, 2017

(54) ELECTRONIC HOUSING FOR SWITCHING DEVICES, IN PARTICULAR FOR LOW-VOLTAGE SWITCHING DEVICES

(71) Applicant: Siemens Aktiengesellschaft, Munich (DE)

(72) Inventors: Paul Fröhlich, Sulzbach-Rosenberg (DE); Manuel Geitner, Ursensollen (DE); Wolfgang Holmer, Schwandorf (DE); Markus Meier, Rieden (DE); Bernhard Richter, Amberg (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 14/364,931

(22) PCT Filed: Mar. 12, 2013

(86) PCT No.: PCT/EP2013/054962

§ 371 (c)(1),
(2) Date: Jun. 12, 2014

(87) PCT Pub. No.: WO2013/139642

PCT Pub. Date: Sep. 26, 2013

(65) Prior Publication Data

US 2015/0008109 A1 Jan. 8, 2015

(30) Foreign Application Priority Data

Mar. 20, 2012 (DE) ..... 10 2012 204 400

(51) Int. Cl.
*H01H 9/02* (2006.01)
*H01H 13/04* (2006.01)
(Continued)

(52) U.S. Cl.
CPC ..... *H01H 9/02* (2013.01); *H01H 9/0271* (2013.01); *H01H 71/025* (2013.01); *H01H 2223/046* (2013.01); *H01H 2229/022* (2013.01)

(58) Field of Classification Search
CPC ..... H01H 9/02; H01H 13/04; H01H 19/04; H01H 21/01; H01H 71/00; H01H 71/02;
(Continued)

(56) References Cited

U.S. PATENT DOCUMENTS 4,977,532 A * 12/1990 Borkowicz ..... G06F 1/18 361/741
5,593,325 A * 1/1997 Bender ..... H01R 9/2625 439/709
(Continued)

FOREIGN PATENT DOCUMENTS

CN 1248385 A 3/2000
CN 1531161 A 9/2004
(Continued)

OTHER PUBLICATIONS

International Search Report PCT/ISA/210 for International Application No. PCT/EP2013/054962 Dated Jun. 6, 2013.
(Continued)

*Primary Examiner* — Anthony R. Jimenez
(74) *Attorney, Agent, or Firm* — Harness, Dickey & Pierce, P.L.C.

(57) ABSTRACT

An electronic housing is disclosed for switching devices, including a housing lower part and a housing upper part. In an embodiment, a guide is formed in the interface region between the housing upper part and the housing lower part such that the housing upper part can be slid onto the housing lower part in the X direction via the guide in a fully automatic process.

18 Claims, 1 Drawing Sheet

(51) Int. Cl.
*H01H 19/04* (2006.01)
*H01H 21/04* (2006.01)
*H01H 71/02* (2006.01)

(58) Field of Classification Search
CPC .. H01H 71/14; H01H 71/025; H01H 71/0264; H01H 73/06; H01H 73/08; H01H 73/10; H01H 2009/02; H01H 2009/0214; H01H 2071/02; H01H 2071/0207; H01H 2071/0242; H01H 2071/0264; H01H 2223/00
USPC ..... 200/303, 293, 296, 297, 318, 333, 345; 174/50, 50.52, 50.62, 520, 527, 535, 537, 174/542, 549, 559–564, 66, 67; 361/1, 361/600, 605, 615–617, 627, 631, 641, 361/657–659, 667, 740, 741; 335/6, 202, 335/167–176, 183–190, 132, 21
See application file for complete search history.

(56) References Cited

U.S. PATENT DOCUMENTS

| | | | | |
|---|---|---|---|---|
| 6,064,018 | A | 5/2000 | Seymour et al. | |
| 6,431,909 | B1 | 8/2002 | Annis | |
| 6,512,669 | B1 * | 1/2003 | Goodwin | H02B 13/025 200/50.12 |
| 6,570,769 | B1 | 5/2003 | Royer et al. | |
| 8,071,877 | B2 * | 12/2011 | Nakayama | H05K 5/0073 174/50 |
| 8,742,274 | B2 | 6/2014 | Hammermayer | |
| 2004/0145348 | A1 | 7/2004 | Bucur et al. | |
| 2006/0245169 | A1 | 11/2006 | Freimuth et al. | |
| 2008/0083549 | A1 * | 4/2008 | Iizuka | H02G 3/081 174/50 |
| 2009/0038920 | A1 * | 2/2009 | Hammermayer | 200/293 |
| 2010/0079226 | A1 * | 4/2010 | Di Maio | H01H 3/28 335/255 |
| 2010/0277874 | A1 | 11/2010 | Agostinho | |

FOREIGN PATENT DOCUMENTS

| | | | | |
|---|---|---|---|---|
| CN | 101395688 | A | 3/2009 | |
| DE | 7930487 | U1 | 1/1980 | |
| DE | 8132259 | U1 | 3/1982 | |
| DE | 10301003 | | 9/2004 | |
| DE | 69927335 | T2 | 6/2006 | |
| EP | 0662741 | A1 | 7/1995 | |
| EP | 0912080 | A2 | 4/1999 | |
| EP | 0976310 | A1 | 2/2000 | |
| JP | WO 2011132487 | A1 * | 10/2011 | H01M 8/2475 |

OTHER PUBLICATIONS

Written Opinion of the International Searching Authority PCT/ISA/237 for International Application No. PCT/EP2013/054962 Dated Jun. 6, 2013.
German Search Report dated Jan. 16, 2013.
Office Action for Chinese Patent Application No. 2013800107159 issued on Sep. 2, 2015 and English translation thereof.
Office Action for Korean Patent Application No. 10-2014-7023621 issued on Mar. 9, 2016.
Office Action for Canadian Patent Application No. 2,867,482 issued on Jul. 22, 2016.

* cited by examiner

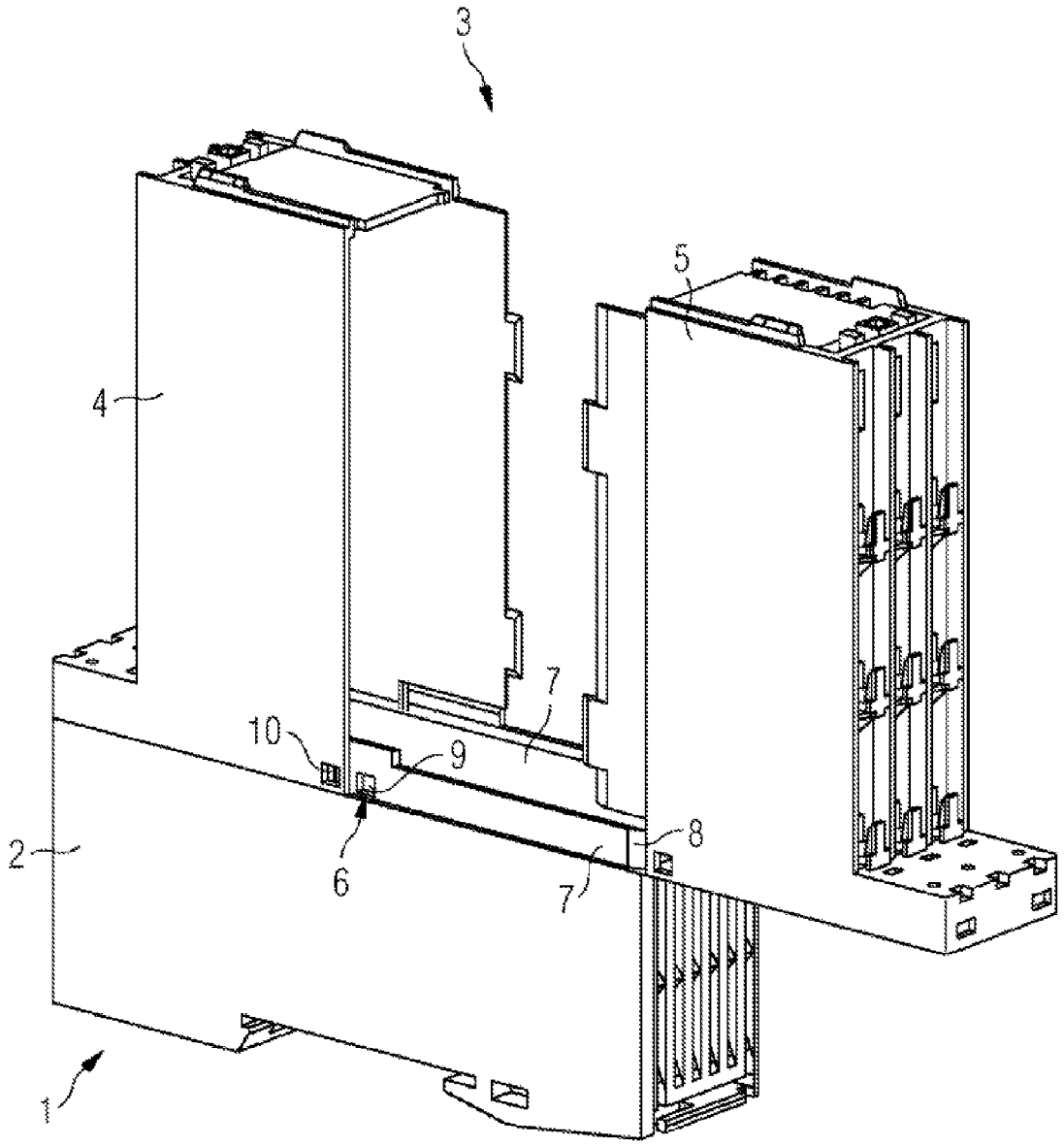
3
5
4
7
10
9
8
2
6
7
1

ELECTRONIC HOUSING FOR SWITCHING DEVICES, IN PARTICULAR FOR LOW-VOLTAGE SWITCHING DEVICES

PRIORITY STATEMENT

This application is the national phase under 35 U.S.C. §371 of PCT International Application No. PCT/EP2013/054962 which has an International filing date of Mar. 12, 2013, which designated the United States of America, and which claims priority to German patent application number DE 102012204400.0 filed Mar. 20, 2012, the entire contents of each of which are hereby incorporated herein by reference.

FIELD

At least one embodiment of the invention generally relates to an electronics housing for switching devices having a housing lower part and a housing upper part.

BACKGROUND

Modular electronics components require functionally correct packaging which enables different setting and operating functions and can be assembled in a manner which is as simple as possible but yet safe and reliable. With the trend of increasing control and automation of processes, in particular in the industrial sector, and simultaneous decentralization of electronics directly into the process as well as the miniaturization of electronics assemblies to form compact devices which are easy to install, suitable electronics housings are therefore increasingly required, wherein, in general, the connection technology is then also integrated in the housing. In this case, the individual electronic devices can, in general, be fitted directly on a mounting rail and preferably connected to one another and to a controller by way of a bus system.

In this connection, depending on the application case, there is a multitude of different electronic devices and housing forms which differ in terms of their size, their design and their function. All of said electronic devices have the common feature that electronic assemblies, usually in the form of printed circuit boards, are arranged in their interior, said electronic assemblies being protected from touching contact and dirt by the electronics housing. Housings such as this are usually of modular design, with the result that it is quickly and easily possible to insert or replace a printed circuit board and hence to adapt the electronic device to different requirements.

The housings often include a housing upper part and a housing lower part. The housing upper part has connections for electrical lines, the connections are connected to the housing lower part by way of plug contacts, and the housing lower part produces the connection to a bus system. The individual housings are in this case designed such that a plurality of housings can be latched on a mounting rail one next to the other, with the result that a plurality of housings together form a housing block. In this case, the individual adjacent housings or the individual adjacent electronic devices can preferably make electrical contact with one another.

Such housings or electronic devices are fastened to the mounting rail owing to a locking element being arranged in the housing lower side, wherein the locking element is latched to the mounting rail when the housing is positioned on the mounting rail. In order to release the housing and hence also the electronic device from the mounting rail, the above-described latching must be released, for which purpose the locking element, which is usually acted upon by a spring, must be pushed back against a spring force.

For this purpose, EP 0 976 310 B1 describes an electrical device having a housing which is composed of two identical housing shells which are assembled in a manner mirror-inverted with respect to one another, wherein the housing is provided with a snap fastening for snapping onto a mounting rail, and wherein the snap fastening is realized by means of two spring latching hooks, each of which is integrated into in each case one housing shell.

Electronics housings which are of modular design and are based on half-shell technology, that is to say which consist of at least two housing parts which are latched with respect to one another, have the disadvantage that no pre-centering or guidance to one another is provided, with the result that they must be fitted freehand.

SUMMARY

At least one embodiment of the present invention resides in providing an electronics housing which can be manufactured using a fully automated process.

An electronics housing is disclosed for a switching device, in particular for a low-voltage switching device. Further example embodiments of the invention emerge from the dependent claims, the description and the drawing. Features and details which are described in connection with the electronics housing also apply in connection with the switching device, and vice versa.

An electronics housing is disclosed for switching devices, in particular for low-voltage switching devices, having a housing lower part and a housing upper part. At least one embodiment of the invention is distinguished here in that a guide is formed in the interface region between housing upper part and housing lower part such that the housing upper part can be slid in the X direction over the guide onto the housing lower part in a fully automated process.

According to at least one embodiment of the invention, a housing lower part which has a so-called support or a guide in the interface region is used, which guide enables a side part housing to be positionable opposite said longitudinal guide in a fully automated manner. This enables precise guidance until latching of the device housing. The housing design is conceived such that the individual parts with their guide parts can be used for all structural widths, that is to say it is also possible for the lower part variants with different heights and depths to be used. By way of this specific housing design principle, the device can thus be fitted in a fully automated manner, since the individual housings are equipped with pre-centering and guidance aids.

The electronics housing according to at least one embodiment of the invention for switching devices, in particular for low-voltage switching devices, includes a housing lower part and a housing upper part. The housing upper part can preferably be constructed in two parts from two housing shells.

In the case of housing upper parts in two parts, on the one hand, it can be provided according to at least one embodiment of the invention that one housing shell is slid onto the housing lower side by pre-centering and guidance aids in a fully automated manner and the other housing shell is slid onto the housing lower part from the other side. On the other hand, however, it is also possible for the two housing shells of the housing upper part to firstly be guided one inside the other and then slid onto the housing lower part over pre-centering and guidance aids in a fully automated manner.

In the interface region between housing upper part and housing lower part, the electronics housing has a guide on the housing lower part, the guide preferably being in the form of a guide rail which is formed so as to be slightly tapered in the end region, such that the fully automated assembly with the housing upper part or with the housing shells is made easier. The guide is preferably formed on two opposite sides of the housing lower part. Latching lugs are arranged on the guides, said latching lugs engaging in latching openings in the housing shells or in the housing upper part.

The electronics housing according to at least one embodiment of the invention offers the advantage that the housing parts which are embodied in a modular fashion can be guided one inside the other in a fully automated manner. For this purpose, pre-centering or guidance aids are formed on the housing parts, by means of which pre-centering or guidance aids this process can be controlled mechanically. Altogether, the housing design is conceived such that the individual parts with their guide parts can be used for all structural widths, that is to say it is also possible for lower part variants with different heights and depths to be used. In this way, an electronics housing of modular design results, which electronics housing can be manufactured in any structural size in a fully automated manner.

BRIEF DESCRIPTION OF THE DRAWINGS

Further advantages and embodiments of the invention will be explained below on the basis of an example embodiment and with reference to the drawing, in which:

DETAILED DESCRIPTION OF THE EXAMPLE EMBODIMENTS

FIG. 1 shows schematically a perspective illustration of an example embodiment of an electronics housing according to the invention, which electronics housing is embodied in a modular fashion and can be assembled in a fully automated manner.

FIG. 1 shows an electronics housing 1 according to an embodiment of the invention for switching devices, in particular for low-voltage switching devices, which has a housing lower part 2 and a housing upper part 3. The housing upper part 3 can preferably be constructed in two parts from two housing shells 4, 5. In the case of housing upper parts 3 in two parts, it can be provided according to the invention that one housing shell 4 is slid onto the housing lower part 2 by pre-centering and guidance aids in a fully automated manner and the other housing shell 5 is slid onto the housing lower part 2 from the other side. On the other hand, however, it is also possible for the two housing shells 4, 5 of the housing upper part 3 to firstly be guided one into the other and then slid onto the housing lower part 2 over pre-centering and guidance aids in a fully automated manner.

In the interface region 6 between housing upper part and housing lower part 2, the electronics housing 1 has a guide 7 on the housing lower part 2, said guide preferably being in the form of a guide rail which is formed so as to be slightly tapered in the end region 8, such that the fully automated assembly with the housing upper part 3 or with the housing shells 4, 5 is made easier. Said guide 7 is preferably formed on two opposite sides of the housing lower part 2. Latching lugs 9 are arranged on the guides 7, said latching lugs 9 engaging in latching openings 10 in the housing shells 4, 5 or in the housing upper part 3.

The electronics housing according to an embodiment of the invention offers the advantage that the housing parts which are embodied in a modular fashion can be guided one into the other in a fully automated manner. For this purpose, pre-centering or guidance aids are formed on the housing parts, by means of which pre-centering or guidance aids this process can be controlled mechanically. Altogether, the housing design is conceived such that the individual parts with their guide parts can be used for all structural widths, that is to say it is also possible for lower part variants with different heights and depths to be used. In this way, an electronics housing of modular design results, which electronics housing can be manufactured in any structural size in a fully automated manner.

The invention claimed is:

1. An electronics housing for switching devices, comprising:

a housing lower part; and a housing upper part, a guide extending along a length of the housing lower part from a first end of the housing lower part to a second end of the housing lower part in an interface region between the housing upper part and the housing lower part such that the housing upper part is slideable over the guide along the length of the housing lower part in a fully automated process, wherein the guide is in the form of two parallel guide rails, the guide having tapered end regions at axial ends of each of the guide rails.

2. The electronics housing of claim 1, wherein the fully automated process is projectable for housing parts of different structural sizes.

3. The electronics housing of claim 1, wherein the housing upper part is slidably engagable with the guide along the length of the housing lower part.

4. The electronics housing of claim 1, wherein at least one tapered end region at an axial end of a first guide rail of the guide rails narrows from a first width to a second width at the axial end of the first guide rail.

5. The electronics housing of claim 1, wherein the guide extends along the length of a top surface of the housing lower part from the first end of the housing lower part to the second end of the housing lower part in an interface region between a bottom of the housing upper part and the top surface of the housing lower part.

6. The electronics housing of claim 1, wherein each of the housing lower part and the housing upper part have a pre-centering aid formed thereon to fixedly center the housing upper part on the housing lower part.

7. The electronics housing of claim 1, wherein at least one tapered end region of a guide rain is aligned with an end wall of the housing lower part.

8. The electronics housing of claim 1, wherein the guide includes at least one latching lug.

9. The electronics housing of claim 8, wherein the latching lug engages in a latching opening in the housing upper part.

10. The electronics housing of claim 8, wherein the fully automated process is projectable for housing parts of different structural sizes.

11. A switching device, comprising:

the electronics housing of claim 1.

12. The switching device of claim 11, wherein the switching device is a low-voltage switching device.

13. The electronics housing of claim 1, wherein the housing upper part is formed by two separable housing shells each being simultaneously engageable with the guide.

14. The electronics housing of claim 13, wherein the fully automated process is projectable for housing parts of different structural sizes.

15. The electronics housing of claim 13, wherein the guide includes at least one latching lug.

16. The electronics housing of claim 15, wherein the latching lug engages in a latching opening in the housing upper part or in the housing shells.

17. A switching device, comprising:

the electronics housing of claim 13.

18. The switching device of claim 17, wherein the switching device is a low-voltage switching device.

* * * * *